United States Patent [19]

Baker

[11] Patent Number: 4,748,547

[45] Date of Patent: May 31, 1988

[54] UPLIGHT LUMINAIRE FOR ACHIEVING UNIFORM ILLUMINANCE ACROSS A CEILING

[76] Inventor: Glenn A. Baker, 6113 E. Calle Tuberia, Scottsdale, Ariz. 85251

[21] Appl. No.: 11,740

[22] Filed: Feb. 6, 1987

[51] Int. Cl.[4] ..... F21S 3/00

[52] U.S. Cl. ..... 362/225; 362/217

[58] Field of Search ..... 362/217, 219, 225

[56] References Cited

U.S. PATENT DOCUMENTS

| | | | |
|---|---|---|---|
| 2,240,179 | 4/1941 | Doane | 362/225 |
| 3,591,798 | 7/1971 | Florence | 240/51.11 |
| 3,647,148 | 3/1972 | Wince | 240/93 |
| 4,242,725 | 12/1980 | Dorima et al. | 362/341 |
| 4,344,111 | 8/1982 | Ruud et al. | 362/33 |
| 4,573,111 | 2/1986 | Herst et al. | 362/337 |

FOREIGN PATENT DOCUMENTS

| | | | |
|---|---|---|---|
| 245300 | 6/1963 | Australia . | |
| 646627 | 10/1964 | Belgium . | |
| 1076056 | 2/1960 | Fed. Rep. of Germany | 362/225 |

OTHER PUBLICATIONS

Lightolier Catalog, "Fluorescent Incandescent Architectural Lighting by Lightolier", (no date given), pp. 8 and 9.

*Primary Examiner*—Stephen F. Husar

*Attorney, Agent, or Firm*—Charles E. Cates; James H. Phillips

[57] ABSTRACT

In order to eliminate glare from a space illuminated by an uplight luminaire, an elongated reflector is employed in conjunction with a pair of mutually vertically oriented fluorescent lamps to obtain uniform light intensity on the space ceiling. The reflector, in cross section, includes a central point from which first and second line segments extend symmetrically in opposite directions and at slight respective downward angles. At the end of each of the first and second line segments, one or more additional line segments extend upwardly and at such angles as to simulate corresponding sections of a parabolic curve. The pair of fluorescent lamps are situated in over and under mutual orientation and are disposed with their axes positioned vertically immediately above and parallel with the longitudinal extension of the central point. As a result of this reflector/lamp-pair combination, a "bat wing" light intensity distribution pattern is achieved in which the least illumination of the ceiling area within the field of illumination is directed straight up and systematically more intense illumination is directed outwardly and angularly to thereby obtain uniform illumination intensity across the ceiling surface. The uniformity of distribution is independent of the spacing of the luminaire from the space ceiling.

3 Claims, 1 Drawing Sheet

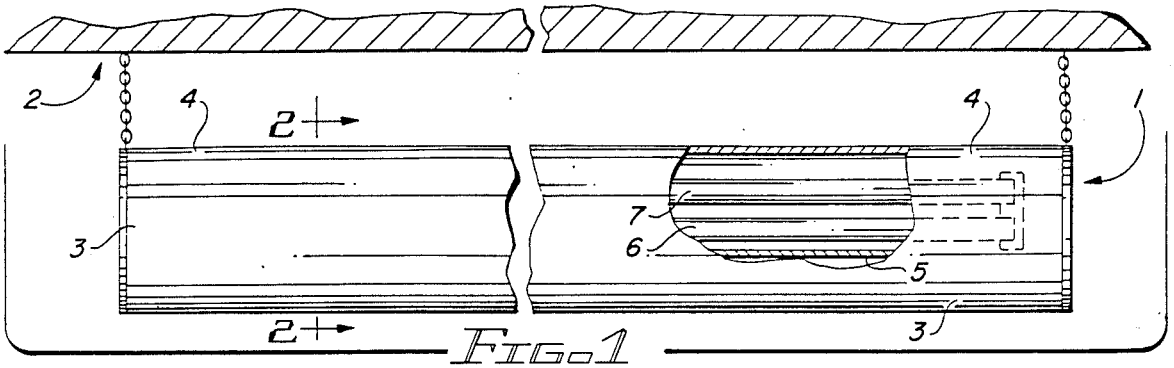
FIG. 1
FIG. 2
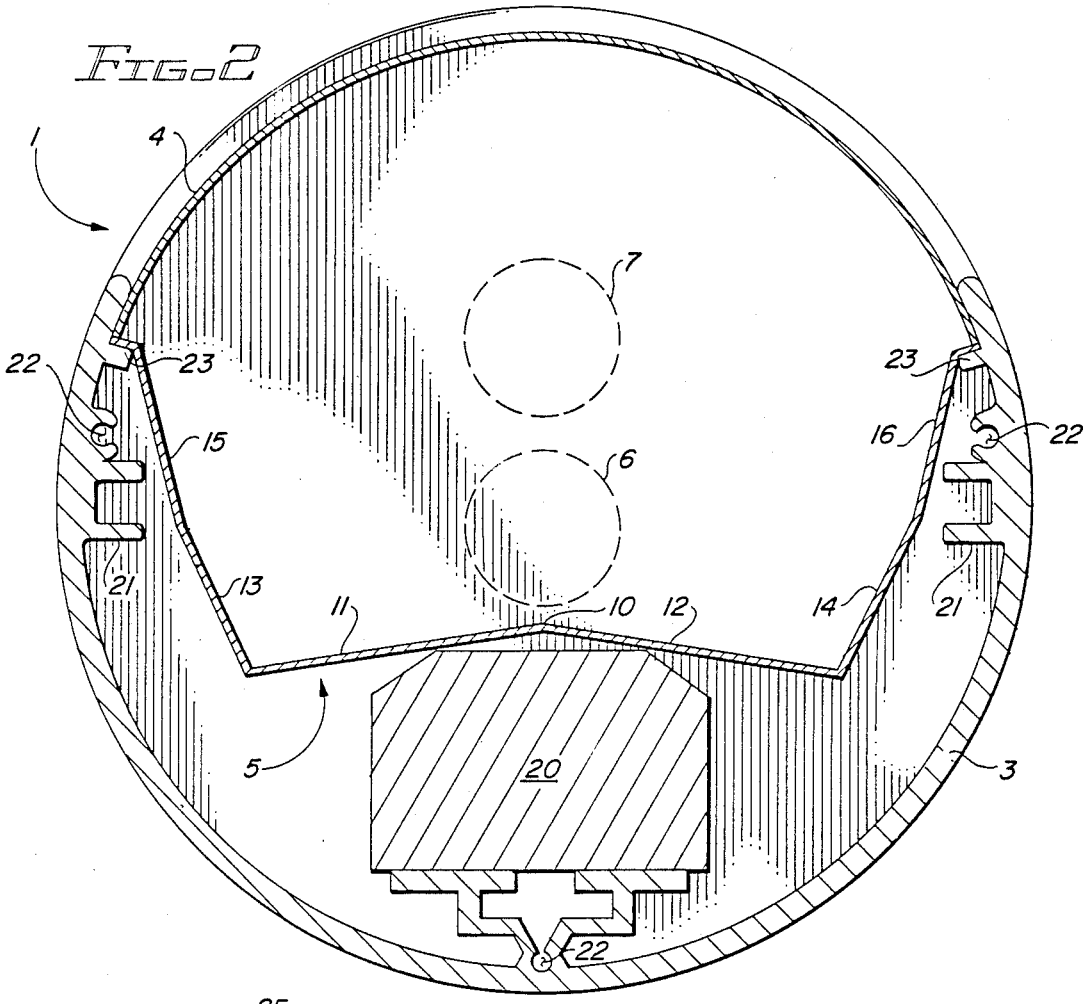
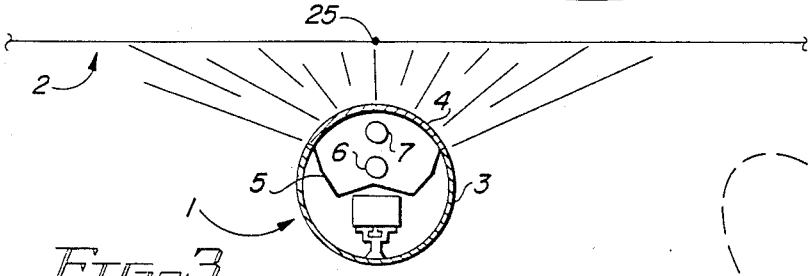
FIG. 3
FIG. 4
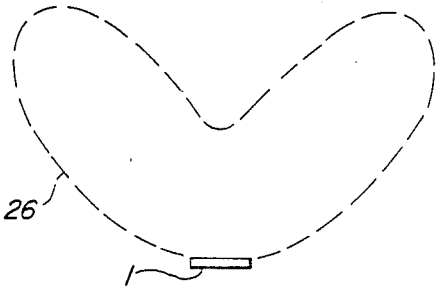

UPLIGHT LUMINAIRE FOR ACHIEVING UNIFORM ILLUMINANCE ACROSS A CEILING

FIELD OF THE INVENTION

This invention relates to the lighting arts and, more particularly, to an indirect lighting fluorescent luminaire for achieving uniform illumination intensity across a ceiling and the work area within the illumination field of the luminaire.

BACKGROUND OF THE INVENTION

While fluorescent lighting has enjoyed a widespread acceptance because of its efficiency in converting electrical energy to light energy and (for most applications) its favorable spectral emissions, there has remained a difficult and notorious problem in its use (in common with the corresponding use of incandescent lighting) which may be broadly categorized as "glare". In recent years, the problem of glare has been particularly manifested in work areas in which computer terminals are used and in which the glare is especially evident on the face of a cathode ray tube with which an operator may be working. Glare on a "computer screen" makes it difficult for the operator to see the information presented and therefore affects the operator's efficiency as well as contributing to operator eye strain. A similar effect is found in watching television in glare prone areas.

Numerous attempts have been made to control or eliminate the glare associated with fluorescent lighting fixtures. For example, downlight troffers and lenses have been employed in systems referred to as "low brightness". This approach did not correct the problem because direct light caused veiling reflections which, in turn, produced a reflection on the computer screen and therefore reduced the operator's "seeability". In a similar system, the lens was replaced with a parabolic louver, but reflections on the computer screen were still apparent. Suspended indirect lighting systems have been employed in which the light was directed onto the ceiling and reflected from the ceiling down to the work area. However, the light distribution produced a cosine curve with a distinctive "hot spot" on the ceiling centrally situated immediately above the luminaire. This distribution not only still resulted in a glare image on a computer screen within the work area, but also produced distracting and inefficient bright and dark lines across the ceiling.

Nonetheless, the use of indirect lighting is a sound preparatory approach to the problem of glare. Thus, those skilled in the art have appreciated that if an indirect fluorescent lighting system can be achieved in which such "hot spots" can be eliminated and uniform intensity of the light impinging across the surface of the ceiling is established, glare will be virtually eliminated. It is to this end that my invention is directed.

OBJECTS OF THE INVENTION

It is therefore a broad object of my invention to provide an improved fluorescent lighting system.

It is another object of my invention to provide such a lighting system employing indirect lighting techniques.

It is a more specific object of my invention to provide a lighting system in which indirect fluorescent lighting techniques are employed in a unique configuration which obtains uniform light intensity distribution across the ceiling within the field of illumination.

In another aspect, it is an object of my invention to provide a luminiare for such a lighting system which is relatively simple and economical to fabricate.

In yet another aspect, it is an object of my invention to provide a luminiare for such a system in which the spacing from the ceiling is not critical in order to obtain the desired uniform intensity distribution.

SUMMARY OF THE INVENTION

Briefly, these and other objects of my invention are achieved by providing a specially shaped ("quasi-parabolic") elongated reflector in an uplight configuration in conjunction with a pair of mutually vertically oriented fluorescent lamps. The reflector, in cross section, includes a central point from which first and second line segments extend symmetrically in opposite directions and at slight respective downward angles. At the end of each of the first and second line segments, one or more (typically two) additional line segments extend upwardly and at such angles as to simulate corresponding sections of a parabolic curve. The pair of fluorescent lamps are situated in over and under mutual orientation and are disposed with their axes positioned vertically immediately above and parallel with the longitudinal extension of the central point. As a result of this unique reflector/lamp-pair combination, a "at wing" light intensity distribution pattern is achieved in which the least candlepower emitted toward the ceiling area within the field of illumination is directed straight up and systematically more intense candlepower is directed outwardly and angularly. The "graduated intensity with angle" emission characteristic of the luminaire compensates for the differing ceiling areas covered at different angles from the luminaire center to thereby obtain uniform illumination intensity across the ceiling surface.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjected claims and the accompanying drawing of which:

FIG. 1 is a partially broken away side view of a typical fluorescent lamp luminaire according to the present invention and particularly illustrating the orientation of the pair of fluorescent lamps with respect to one another, the reflector and the ceiling in the luminaire's field of illumination;

FIG. 2 is a cross sectional view taken along the lines 2—2 of FIG. 1 and more specifically illustrating the geometrical relationships between the reflector and its various segments and the over and under fluorescent lamp pair; and FIG. 3 provides a general view of the light distribution relationship between the luminaire and a ceiling from which it is suspended; and FIG. 4 illustrates the "bat wing" light intensity distribution curve achieved by the reflector/lamp-pair combination of the present invention.

DETAILED DESCRIPTION OF THE INVENTION

Referring now to FIG. 1, there is shown a partially broken away side view of an elongated luminaire 1 according to the present invention suspended from a ceiling 2 in an exemplary installation. The luminaire 1 is encompassed by an external housing 3 and a translucent cover 4 situated along the upper portion of the luminaire to transmit light emitted from within the luminaire to the ceiling 2 to thereby obtain indirect lighting in the room in which the luminaire is installed. As will be discussed more fully below in conjunction with the description of FIG. 2, the luminaire 1 includes a elongated upwardly opening reflector 5 above which are centrally positioned first and second fluorescent lamps 6, 7 oriented vertically with respect to one another. Thus, it will immediately be appreciated that the ceiling region directly above the luminaire 1 receives most of its illumination only from the upper fluorescent lamp 7 which shields the direct vertical emission of the lower lamp 6.

Attention is now directed to FIG. 2 which more particularly illustrates the geometrical relationships between the various components of the luminaire 1. Reflector 5 is symmetrical in cross section and may thus be described from a central point 10 (of which the longitudinal extension is the centerline of the reflector 5).

First and second line segments 11, 12 extend from the central point 10 in opposite directions and at slight downward angles which preferably fall within the range 5° to 15° with respect to the horizontal and, in a presently preferred embodiment, is approximately 9°. The first and second line segments 11, 12 extend for like predetermined distances which may typically (for luminaires employing fluorescent lamps with a nominal 1.0 inch diameter) fall within the range 1.5 inches to 2.5 inches and, in the presently preferred embodiment, is approximately 1.9 inches. At the respective outboard ends of the first and second line segments 11, 12, third and fourth line segments 13, 14 adjoin and extend upwardly at angles typically falling within the range 105° to 115° with respect to the first and second line segments 11, 12 to which they are respectively adjoined and extend for like distances typically falling within the range 0.9 to 1.2 inches. In the presently preferred embodiment of the invention, the line segments 13, 14 adjoin the line segments 11, 12 respectively, at angles of approximately 106° and extend for approximately 1.05 inches.

Joining the respective outboard ends of the third and fourth line segments 13, 14 are fifth and sixth line segments 15, 16. The fifth and sixth line segments 15, 16 extend upwardly from the third and fourth line segments 13, 14 at angles typically falling within range of 160° to 165° with respect to the third and fourth line segments and extend for distances typically falling within the range 1.0 inch to 1.5 inches.

It will be appreciated that the line segments 13, 14, 15, 16 simulate a parabolic curvature and that the simulation may be effected by more line segments or even directly rolled into a smooth near or actual parabolic curvature. However, the configuration illustrated in FIG. 2 has been found to functionally compare very favorably to more complex curvatures and has the distinct advantage of ease of fabrication. Preferably, the elongated reflector 5 is fabricated from a single appropriately bent piece of specular aluminum which may be on the order of 0.020 to 0.025 inches thick.

As previously mentioned, the mutual orientation of the fluorescent lamp-pair 6, 7 and their relationship to the reflector 5 is a key feature of the present invention. Thus, the lower fluorescent lamp 6 situated with its axes directly about the central point 10 of the reflector 5 cross section and parallel to its longitudinal extension. The upper fluorescent lamp 7 is disposed above the lower lamp 6 and has its axis in alignment with the axis of the lower lamp 6 and the extension of the central point 10. The axis of the lower lamp 6 may be on the order of five-eights inches (for a 1.0 inch diameter lamp) above the central point 10, and the axis of the upper lamp 7 may be on the order of one and one-quarter inches above the axis of the lower lamp 6 to obtain approximately a one-quarter inch spacing between the outer surfaces of the lamps. While these dimensions are not critical, the outer periphery of the lower lamp 6 should be relatively close to the centerline (the longitudinal extension of the central point 10) of the reflector 5, and the outer periphery of the upper lamp 7 should be relatively close to the outer periphery of the lower lamp 6 to obtain the shielding effect previously mentioned and which contributes significantly to the elimination of a "hot spot" centrally disposed on the ceiling directly above the luminaire 1.

The electrical hardware associated with energizing and supporting the lamps 6, 7, is conventional. Thus, power line energy may be supplied by any appropriate wiring mean, and a ballast 20 can be conveniently placed beneath the reflector 5 within the housing 3 intermediate along the length of the luminaire 1. Conventional end sockets for receiving the fluorescent tube terminals may be supported by brackets 21, and screw attachments 22 permit the attachment of end plates to close off the luminaire ends. The translucent dust cover 4 may be supported on inwardly extending lips 23 provided on each side near the upper terminus of the housing 3.

Attention is now directed to FIG. 3 and also to FIG. 4 which illustrates a cross section of the light intensity distribution curve obtained by the combination of the reflector 5 and vertically oriented lamp-pair 6,7. The region of the ceiling 2 directly above the luminaire 1 is illuminated, for the most part, by the emissions from the upper lamp 7 in that direction. However, as the distance to either side of the point 25 (which is in alignment with the axes of the lamp 6, 7 and the center point of the reflector 5) increases, the illumination intensity angularly directed from the summation of the light issued by the luminaire 1 correspondingly increases with the result that the total lumens falling upon a given area of a ceiling 2 within the field of illumination of the luminaire 1 is approximately the same as the lumens impinging upon any other equal sized area of the ceiling within the field of illumination. Thus, the distribution curve 26, as shown in FIG. 4, demonstrates that the least light is directed straight up to the ceiling region closest to the luminaire 1 and that progressively greater intensity is directed outwardly corresponding to the distance from the point 25 to achieve the sought after uniform lumens per area pattern which totally eliminates hot spots. As the outer limits of the field of illumination are reached, the intensity falls off rapidly. For those illuminated ares in which a single luminaire cannot provide sufficient cover to uniformly illuminate substantially the entire ceiling, two or more appropriately spaced and positioned luminaires 1 may be employed. Those skilled in the art will appreciate that luminaires of differing lengths are contemplated according to the commonly available commercial fluorescent lamps and their requirements for meeting a given lighting environment.

A subtle feature of the subject luminaire is that the spacing from the ceiling is not a factor in obtaining the uniform intensity distribution. If the luminaire is moved from a first position to a second, lower position, the intensity remains uniform, but fewer lumens per area impinge upon a larger area. Conversely, if the luminaire is moved from a first position to a second, higher position, the intensity remains uniform, but more lumens per area impinge upon a smaller area. Thus, the spacing from the ceiling and the number of luminaires employed can be readily determined to yield a predetermined degree of brightness required in a given lighting environment.

As a result of uniformly illuminating the ceiling of an area with the subject uplight luminaire which employs the unique combination of a "quasi-parabolic" reflector and a pair of over and under oriented fluorescent lamps, "hot spots" are eliminated with the consequent elimination of glare and a pronounced improvement of the working and living conditions in both home and office environments, especially in commercial applications in which computer terminals, CRT's and desk top working areas are considered. Glare is essentially eliminated from the faces of the cathode ray tubes with a corresponding increase in operator efficiency, accuracy, and comfort. The luminaire is not, of course, limited to such applications; its use will eliminate glare in whatever environment in which it is employed.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific embodiments and operating requirements without departing from those principles.

I claim:

1. An uplight luminaire for emitting light in a pattern which obtains uniform intensity distribution of light impinging on the surface of a ceiling in the field of illumination of said uplight luminaire, said uplight luminaire comprising:

(A) an elongated, horizontally disposed reflector, said reflector, in cross section, including:

1. a central point;
2. first and second line segments symmetrically extending away from said central point in opposite directions and at respective downward angles falling within the range 5° to 15° with respect to the horizontal for identical first predetermined distances;
3. third and fourth line segments adjoining said first and second line segments and extending upwardly from the respective outboard terminations thereof at angles falling within the range 105° and 115° with respect to said first and second line segments, respectively, for identical second predetermined distances; and
4. fifth and sixth line segments adjoining said third and fourth line segments and extending upwardly from the respective outboard terminations thereof at angles falling within the range 160° and 165° with respect to said third and fourth line segments, respectively, for identical third predetermined distances; and (B) first and second elongated fluorescent lamps situated in over and under mutual orientation and disposed with their axes vertically situated above said central point.

2. The uplight luminaire of claim 1 in which:

(A) said first predetermined distance falls within the range 1.5 inches to 2.5 inches; (B) said second predetermined distance falls within the range 1.0 inch to 1.1 inches; and (C) said third predetermined distance falls within the range 1.0 inch to 1.5 inches.

3. The uplight luminaire of claim 2 in which said second fluorescent lamp is positioned with its axis five-eights inches above said central point and said first fluorescent lamp is positioned with its axis one and one-quarter inches above said axis of said first fluorescent lamp.

* * * * *